US007340209B2

(12) United States Patent
Aramata et al.

(10) Patent No.: US 7,340,209 B2
(45) Date of Patent: Mar. 4, 2008

(54) FUSING DEVICE WITH ROUGH SURFACE AND METHOD FOR MANUFACTURING THE FUSING MEMBER

(75) Inventors: Sumio Aramata, Tokyo (JP); Naoki Sunaga, Tokyo (JP); Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 73 days.

(21) Appl. No.: 11/030,974

(22) Filed: Jan. 10, 2005

(65) Prior Publication Data

US 2005/0163541 A1 Jul. 28, 2005

(30) Foreign Application Priority Data

Jan. 15, 2004 (JP) ..... 2004-008234

(51) Int. Cl.
*G03G 15/20* (2006.01)

(52) U.S. Cl. ..... 399/333

(58) Field of Classification Search ..... 399/328, 399/333

See application file for complete search history.

(56) References Cited

U.S. PATENT DOCUMENTS 5,592,275 A * 1/1997 Echigo et al. ..... 399/328
5,715,507 A * 2/1998 Kobayashi et al. ..... 399/328
2002/0018663 A1* 2/2002 Furukawa et al. ..... 399/329

FOREIGN PATENT DOCUMENTS

JP 2002-31982 1/2002

* cited by examiner

*Primary Examiner*—David M. Gray
*Assistant Examiner*—Ruth N LaBombard
(74) *Attorney, Agent, or Firm*—Rabin & Berdo, PC

(57) ABSTRACT

To improve image quality upon preventing abrasion traces from strongly forming on a surface of a fusing member, an invented fusing device has a pressure member, a fusing member movably arranged as faced with the pressure member, and a contact element arranged in contact with an outer circumferential surface of the fusing member, with the surface roughness of the fusing member of 1.0 to 4.0 [μm]. When the fusing member is moved in contact with the contact element, the contact element rubs a surface of the fusing member, but in the fusing member, the portion in contact with the contact element and the portion not in contact with the contact element become about equal in the surface roughness with the above surface roughness.

7 Claims, 6 Drawing Sheets

FUSING DEVICE WITH ROUGH SURFACE AND METHOD FOR MANUFACTURING THE FUSING MEMBER

BACKGROUND OF THE INVENTION

1. Field of the Invention

This invention relates to a fusing device and a method for manufacturing a fusing member.

2. Description of Related Art

Conventionally, an image forming apparatus such as, e.g., a printer, a facsimile machine, or a photocopier is arranged with a fusing device to fuse toner images onto papers, in which the fusing device has a fusing roller or a fusing belt as a fusing member installed inside with a heater, as well as a pressure roller arranged to face to the fusing roller or the fusing belt.

In thus structured fusing device, for example, when a paper to which the toner image is transferred passes between the fusing roller and the pressure roller, the toner in the toner image is heated and melted with the fusing roller, thereby being pressed onto the paper with the pressure roller.

For stable operation of the above fusing, surface temperature of the fusing roller is detected, and fusing temperature for fusing the toner image is controlled based on the detected surface temperature (ref., e.g., Japanese Patent Application Publication No. JA2002-31,982).

In the above conventional fusing device, however, a thermistor needs to be arranged so as not to be parted from the surface of the fusing roller when used to detect the surface temperature of the fusing roller, so the thermistor rubs against the surface of the fusing roller while the fusing roller rotates.

FIG. 2 is an illustration for a state of the conventional fusing roller.

In the illustration, numeral 11 is a fusing roller, and when the fusing roller 11 is rotated as in contact with the thermistor, not shown, the thermistor rubs the surface of the fusing roller 11, thereby rendering surface roughness of the fusing roller 11 at a portion in contact with the thermistor rougher than that at other portions not in contact with the thermistor, and thereby strongly forming thermistor's traces E1 as abrasion traces in succession in a circumferential direction. Particularly, when the fusing roller 11 strongly formed with thermistor's traces E1 is used for solid printing, the thermistor's traces E1 are formed as gloss uneveness in printed results, so that the image quality is deteriorated.

It is an object of this invention to solve the above problems in the conventional fusing device and to provide a fusing device and a method for manufacturing a fusing member capable of improving the image quality upon preventing any abrasion trace from strongly forming on the surface of the fusing member.

SUMMERY OF THE INVENTION

To achieve the above objects, a fusing device according to this invention has a pressure member; a fusing member movably arranged as faced with the pressure member and heated with heat generated by a heating element; and a contact element arranged as in contact with an outer circumferential surface of the fusing member.

The surface roughness of the fusing member is set to 1.0 to 4.0 [μm].

According to this invention, the fusing member has the pressure member; the fusing member movably arranged as faced with the pressure member and heated with heat generated by the heating element; and the contacting element arranged as in contact with the outer circumferential surface of the fusing member.

The surface roughness of the fusing member is set to 1.0 to 4.0 [μm].

In such a case, when the fusing member is moved as in contact with the contact element, the contact element rubs the surface of the fusing member, but the portion in contact with the contact element and the portion not in contact with the contact element have substantially the same surface roughness because the surface roughness of the fusing member is set to 1.0 to 4.0 [μm].

It is therefore possible to prevent the abrasion traces from strongly forming on the surface of the fusing member, so the image quality can be improved.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DETAILED DESCRIPTION OF THE PREFERRED EMBODIMENTS OF THE INVENTION

Hereinafter, embodiments according to this invention will be described with reference to the drawings. In these embodiments, a color printer will be described as an image forming apparatus, but this invention is applicable to a facsimile machine, a photocopier, or the like.

Figure 3:
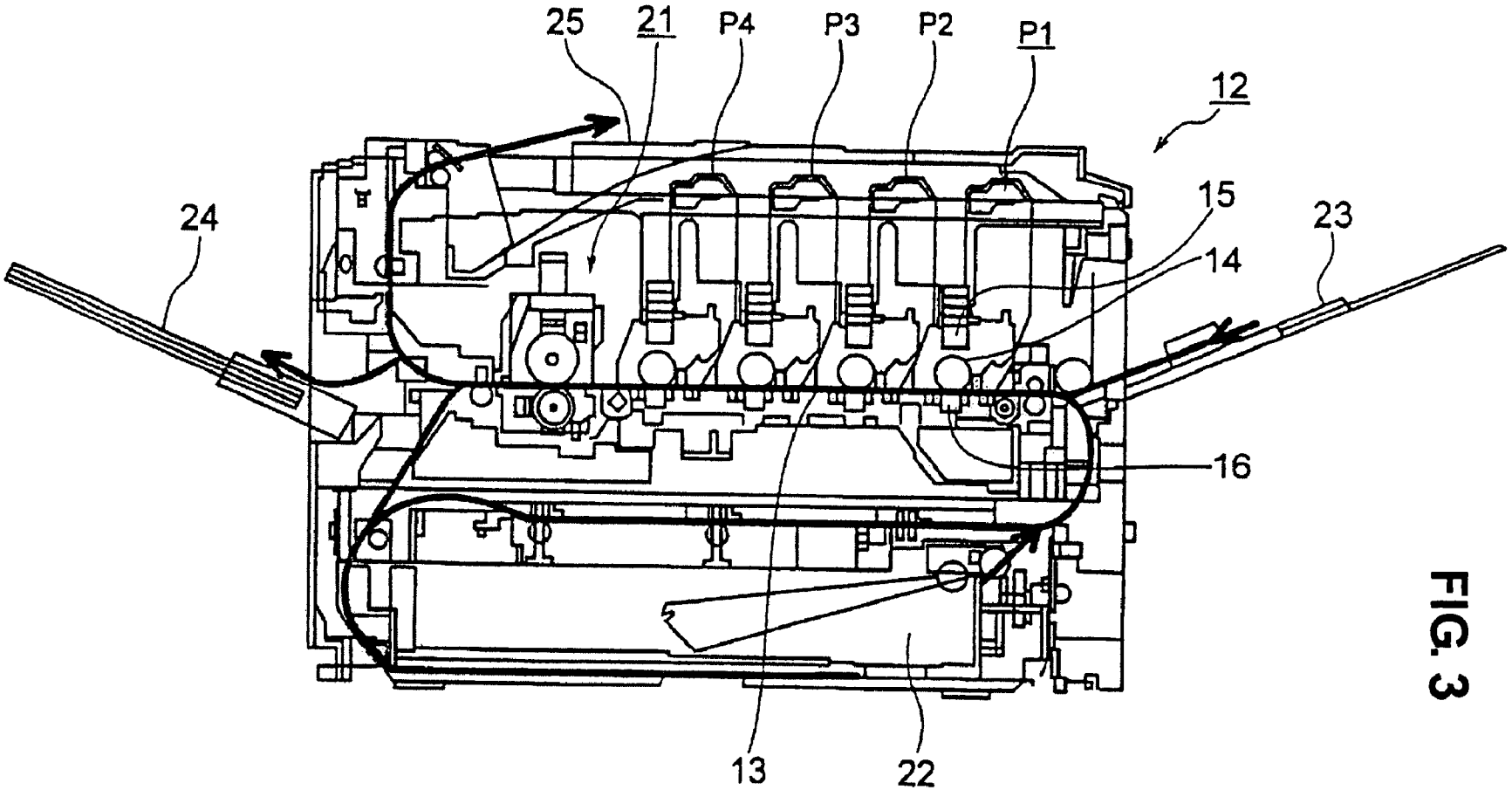
FIG. 3 is a schematic view showing a printer according to the first embodiment of this invention.
Figure 4:
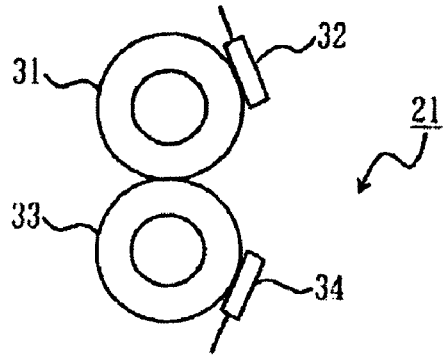
FIG. 4 is a cross-sectional view showing a schemata of a fusing device according to the first embodiment of this invention.
Figure 5:
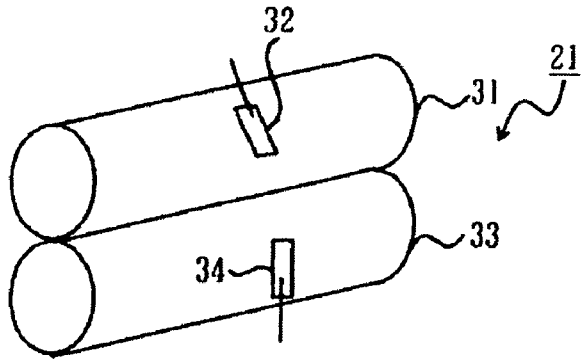
FIG. 5 is a schematic perspective view showing a fusing device according to the first embodiment of this invention.
Figure 6:
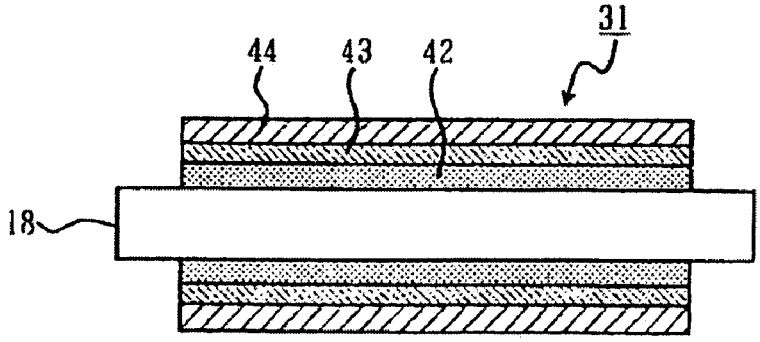
FIG. 6 is a cross-sectional view showing the fusing roller according to the first embodiment of this invention.

FIG. 3 is a schematic side view showing a printer according to the first embodiment of this invention; FIG. 4 is a schematic cross-sectional view showing a fusing device according to the first embodiment of this invention; FIG. 5 is a schematic perspective view showing a fusing device according to the first embodiment of this invention; and FIG. 6 is a cross-sectional view showing a fusing roller according to the first embodiment.

In FIG. 3, numeral 12 is a printer while numeral 13 is a transfer belt serving as a belt member rendered to run inside the printer 12 to convey papers as recording media, not shown, and toner cartridges P1 to P4 are arranged from an upstream side to a downstream side in the paper conveyance direction. Each of the toner cartridges P1 to P4 constitutes an image forming unit for each color, i.e., yellow, magenta, cyan, and black, thereby forming images in each color. It is to be noted that such as OHP sheets, other than papers, can be used as recording media.

Each of the toner cartridges P1 to P4 has a photosensitive drum 14 serving as an image carrier; a charging roller serving as a charging device, not shown in the drawings; a developing roller serving as a developing device, not shown in the drawings; a cleaning device not shown in the drawings; or the like, while on an outside of each of the toner cartridges P1 to P4, an exposure device 15 is arranged as faced with each of the photosensitive drums 14, and a transfer roller 16 serving as a transfer device is arranged as faced with each of the toner cartridges P1 to P4 located astride the transfer belt 13.

A fusing device 21 is, furthermore, arranged on a downstream side with respect to the toner cartridge P4 in the paper conveyance direction. It is to be noted that numeral 22 is a cassette serving as a medium container for containing papers; numeral 23 is a feeder for feeding papers; numeral 24 is a delivery stacker for delivering printed papers; and numeral 25 is a paper delivery tray for delivering printed papers.

A paper contained in the cassette 22 is fed to be conveyed with the transfer belt 13, so the toner image in each color is transferred onto the paper at the toner cartridges P1 to P4. The toner in the toner image is fixed to a paper by heated, melted, and pressed. The toner image is thus fused onto a paper.

The fusing device 21 is explained next.

In FIG. 4 and FIG. 5, numeral 31 is a fusing roller serving as a fusing member arranged in a movable and rotatable manner; numeral 32 is a thermistor serving as the first contact element arranged in contact with a paper transmission area functioning as a medium transmission area on an outer circumferential surface of the fusing roller 31, as well as serving as the first thermal detecting member and the first contact element for detecting the surface temperature of the fusing roller 31; numeral 33 is a pressure roller serving as a pressure member rotatably arranged in contact with the fusing roller 31; and numeral 34 is a thermistor serving as the second contact element arranged in contact with the paper transmission area functioning as the medium transmission area on the outer circumferential surface of the pressure roller 33, as well as serving as the second thermal detecting member and the second contact element for detecting surface temperature of the pressure roller 33.

Halogen lamps respectively serving as the first and second heating elements, not shown in the drawings, are respectively arranged inside the fusing roller 31 and the pressure roller 33, while each halogen lamp is turned on or off based on the temperature detected with the respective thermistors 32 and 34, and therefore, the surface temperature of the fusing roller 31 and the pressure roller 33 can be controlled so that the surface temperature of the fusing roller 31 and the pressure roller 33 is to be a targeted fusing temperature.

In this embodiment, the halogen lamp is arranged in each of the fusing roller 31 and the pressure roller 33 but can be arranged in the fusing roller 31 only.

The fusing roller 31 is explained next.

In FIG. 6, numeral 18 is a core metal made of aluminum or the like. An elastic layer 42 is formed by applying adhesive, not shown, onto the core metal 18 and by thereafter covering the adhesive with a silicon rubber. Furthermore, an intermediate layer 43 serving as a base material is formed by applying a primer, not shown, onto the elastic layer 42 and by thereafter covering the primer with fluoric rubber. Coating is subsequently made on the intermediate layer 43 in using fluorocarbon resin. That is, the adhesive is applied onto the intermediate layer 43, and thereafter the adhesive is covered, upon coating, with a polyfluoroalkoxy resin (PFA resin) serving as a mold releasing material to form a surface layer 44. After drying and annealing a roller member serving as an original fusing member thus structured, a mat process is subsequently made thereto to form the fusing roller 31.

It is to be noted that in this embodiment, the surface layer 44 is formed by applying the polyfluoroalkoxy resin onto the intermediate layer 43, but can be formed by covering the intermediate layer 43 with a tube composed of the polyfluoroalkoxy resin.

Figure 1:
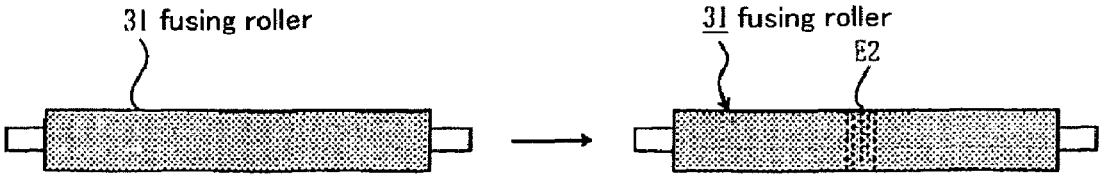
FIG. 1 is a view showing a state of a fusing roller according to the first embodiment of the invention.
Figure 2:
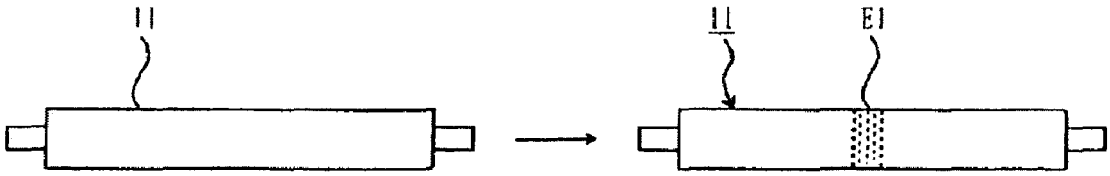
PRIOR ART FIG2.
FIG. 2 is an illustration for a state of a conventional fusing roller.

In the meantime, on surface treatment of the fusing roller 11 (in FIG. 2), a smoothing process is conventionally made as the surface treatment after the coating is done, and in that case, when the thermistor rubs against the surface of the fusing roller, traces E1 of the thermistor may be strongly formed as traces of rubbing.

In this embodiment, therefore, instead of the smoothing process, the mat process is made as the surface treatment to prevent the thermistor from forming strongly with traces.

Figure 7:
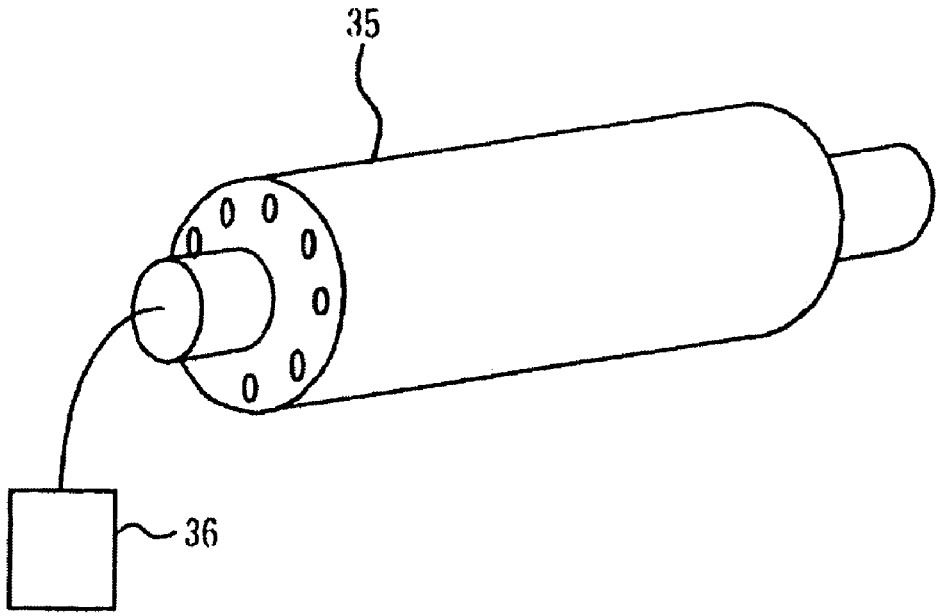
FIG. 7 is a view showing a manufacturing device for the fusing roller according to the first embodiment of this invention.
Figure 8:
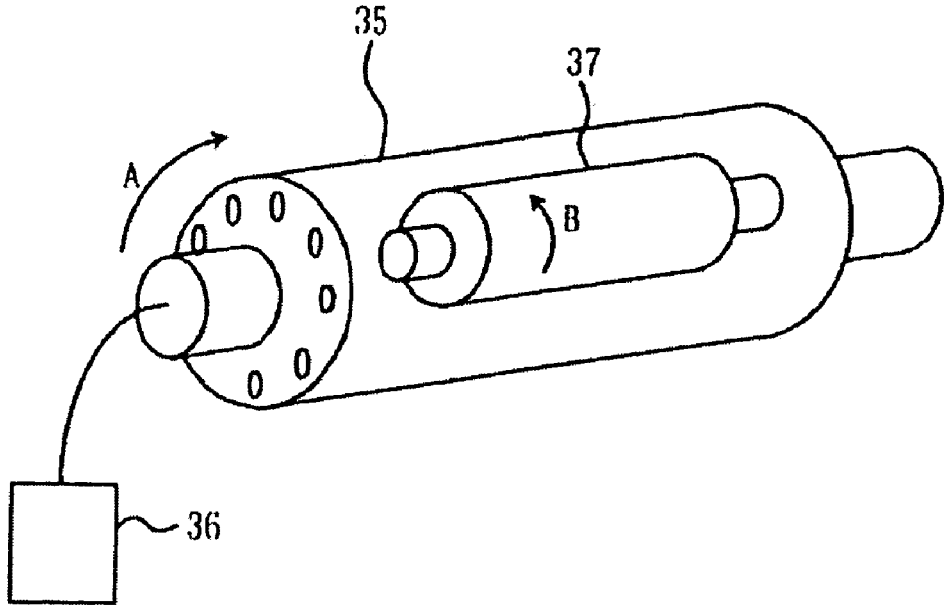
FIG. 8 is a view showing a manufacturing method for the fusing roller according to the first embodiment of this invention.
Figure 9:
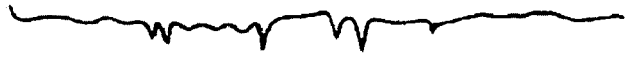
FIG.9 PRIOR ART
FIG. 9 is a view showing a state of a surface of the conventional fusing roller.
Figure 10:
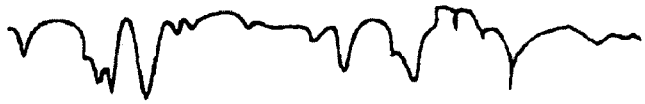
FIG. 10 is a view showing a state of a surface of the fusing roller according to the first embodiment of this invention.

FIG. 6 is a view showing a state of the fusing roller according to the first embodiment of the invention; FIG. 7 is a view showing a manufacturing device for the fusing roller according to the first embodiment of this invention; FIG. 8 is a view showing a manufacturing method for the fusing roller according to the first embodiment of this invention; FIG. 9 is a view showing a state of a surface of the conventional fusing roller; and FIG. 10 is a view showing a state of a surface of the fusing roller according to the first embodiment of this invention.

The manufacturing device for the fusing roller has a jacket roll 35 serving as a member for the mat process, arranged in a rotatable and movable manner, and a surface of the jacket roll 35 is coated with chrome, and furnished as mat having an arbitrary roughness, surface roughness of such as, e.g., 70 to 80 [μm] (it is to be noted that "to" indicates expediently the range of not less than 70 [μm] and not more than 80 [μm]. Hereinafter, other variable range is also indicated with "to".). Furthermore, an induction heating device not shown is arranged inside the jacket roll 35, and the induction heating device and a power supply 36 are connected.

The power supply 36 supplies electric power to the induction heating device, so the induction heating heats the jacket roll 35 to set the surface temperature to 200 to 350 degrees Celsius. The surface roughness (undulation) of the jacket roll 35 is transferred onto the surface of the roller member 37 when the roller member 37, as shown in FIG. 8, is pressed with pressing force of 1 to 10 [kg] against the jacket roll 35, and in that state, the jacket roll 35 is rotated in a direction of arrow A for 5 to 30 seconds while the roller member 37 is driven to be rotated in a direction of arrow B. As the result, the surface of the roller member 37 is furnished with mat having an arbitrary surface roughness Rz. The fusing roller 31 can be manufactured in this way. In that case, since the mat process is made instead of the conventional smoothing process, the number of processing steps for manufacturing fusing roller 31 does not increase.

In the meantime, regarding the conventional roller 11, the roller member has the surface roughness Rz of 1.0 to 5.0 [μm] before the smoothing process is implemented, whereas, as shown in FIG. 9, the surface roughness of the roller member, i.e., the fusing roller 11 is set to less than or equal to 1.0 [μm] after the smoothing process is implemented. On the other hand, in this embodiment, of the roller member 37 has the surface roughness Rz of 1.0 to 5.0 [μm] before the smoothing process is implemented, whereas, as shown in FIG. 10, the surface roughness of the roller member 37, i.e., the fusing roller 31 is set to 1.0 to 4.0 [μm] when indicated as average roughness.

When the fusing roller 31 thus manufactured is mounted to the printer 12, and rotated as in contact with the thermistor 32, the surface of the fusing roller 31 is rubbed by the thermistor 32, but the portion in contact with the thermistor 32 and the portion not in contact with the thermistor 32 are about equal in the surface roughness Rz since the surface of the fusing roller 31 is roughed with the mat process.

Because traces E2 of the thermistor, therefore, can be prevented from forming strongly on the surface of the fusing roller 31, no trace E2 of the thermistor is formed as gloss unevenness in the printed results even where solid-print or the like is made in using the thermistor 31, so image quality can be improved.

In the meantime, the surface roughness Rz of the fusing roller 31 corresponds to that of the jacket roll 35, so the surface roughness Rz of the fusing roller 31 can be changed by changing the surface roughness of the jacket roll 35. Regarding the jacket roll 35, rough cutting is firstly conducted to the jacket roll member with use of a predetermined turning tool during a lathe process, and the surface of the jacket roll member is secondly ground with a grinder stone so that the roughness thereof becomes about 1 [μm]. A blasting process is subsequently made to the surface of the jacket roll member, and according to this process, an undulation having necessary roughness is formed on the surface of the jacket roll member, so that the surface roughness of the jacket roll 35 can be set to have the predetermined amount.

Evaluation result when image quality is evaluated upon changing the surface roughness Rz of the fusing roller 31, is next explained.

TABLE 1

| Surface Roughness Rz [μm] | Image Quality Level | Remarks |
|---|---|---|
| 5.0 | C | Image quality deteriorates as a whole |
| 4.5 | C | Image quality deteriorates as a whole |
| 4.0 | B | Image quality slightly deteriorates in part |
| 3.5 | A | |
| 3.0 | A | |
| 2.5 | A | |
| 2.0 | A | |
| 1.5 | A | |
| 1.0 | B | Traces of the thermistor forms feebly |
| 0.5 | C | Traces of the thermistor forms |

In that case, evaluation is made based on the following condition.

As an evaluation equipment, the color printer 12 shown in FIG. 3 is used.

As a fusing roller, fusing rollers are used, and the surface roughness Rz of each fusing roller is changed by 0.5 [μm] each in the range of 0.5 to 5.0 [μm].

Regarding an evaluation method, the fusing device 21 installed with each of the fusing rollers is mounted to the printer 12; a thick paper (ream weight 200 [g/m$^2$]) is used as a paper; and a monochromatic black solid-printing is made to a full page of 100 sheets. Concerning gloss on a printed surface of a printed result, a confirmation is made with visual observation as to whether or not deterioration of the image quality due to the traces of the thermistor occurs. The judgment as to the deterioration of the image quality can be made depending on whether or not the gloss on the portion corresponding to the traces of the thermistor is inferior to that on the surrounding portion.

Regarding the image quality level, Mark "A" indicates a good printed result.

Mark "B" indicates that where the monochromatic black solid-printing is made on the full page, difference in the gloss partially occurs on portions corresponding to the traces of the thermistor, thereby resulting in the deterioration of the image quality, but where regular printing, e.g., printing having a lower density than the monochromatic black solid-printing is made, the difference in the graze does not occur, so the deterioration of the image quality is not observed.

Mark "C" indicates that the difference in the gloss occurs on the portions corresponding to the traces of the thermistor.

It is found out from Table 1 that where the surface roughness Rz is set to 1.0 to 4.0 [μm] with respect to the average roughness, the image quality does not deteriorate. Preferably, when the surface roughness Rz is set to 1.5 to 3.5 [μm] with respect to the average roughness, the image quality does not deteriorate at all, thereby being able to be stabilized.

It is to be noted that, as well as the above, where the surface layer 44 is formed by covering the intermediate layer 43 with the tube composed of the polyfluoroalkoxy resin, when the surface roughness Rz is set to 1.0 to 4.0 [μm] with respect to the average roughness, the image quality does not deteriorate, and further, when the surface roughness Rz is set to 1.5 to 3.5 [μm] with respect to the average roughness, the image quality does not deteriorate at all, thereby being able to stabilize.

Furthermore, releasing property can be improved since the surface of the fusing roller 31 is made rough, so a paper after the toner is fused thereto can be released smoothly as well as stably.

In this embodiment, explained is that the thermistor 32 is in contact with the surface of the fusing roller 31, but this invention can be applied to another case such that, instead of the thermistor 32 as the contact element, an element normally in contact with the surface of the fusing roller 31, e.g., a gauge to maintain a distance between the fusing roller 31 and other predetermined members, is arranged as in contact with the surface of the fusing roller 31.

The second embodiment is next explained in which a fusing belt is used as the fusing member.

Figure 11:
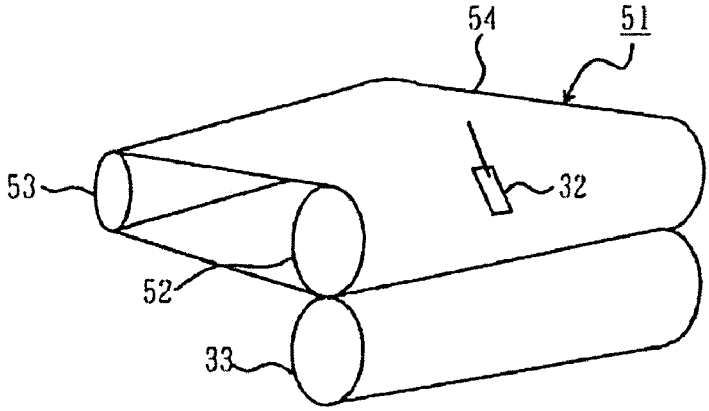
FIG. 11 is a perspective view showing a fusing device according to the second embodiment of this invention.
Figure 12:
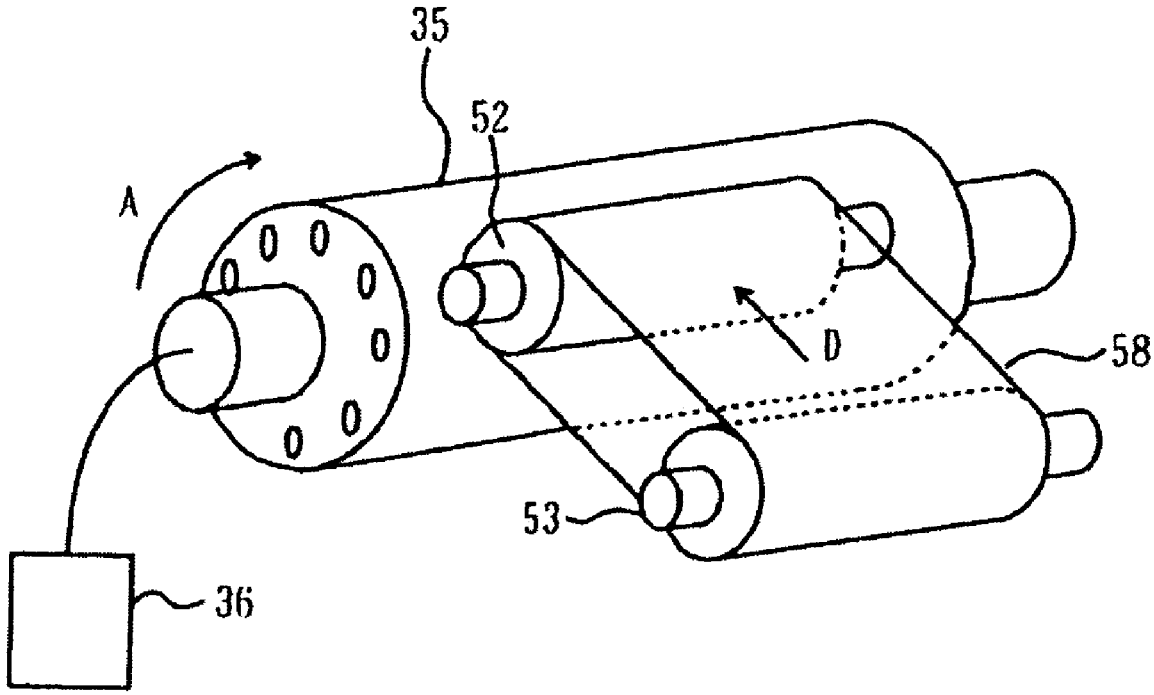
FIG. 12 is a view showing a manufacturing method for a fusing belt according to the second embodiment of this invention.

FIG. 11 is a perspective view showing a fusing device according to the second embodiment of this invention; and FIG. 12 is a view showing a manufacturing method for the fusing belt according to the second embodiment of this invention.

In the drawings, numeral 51 is a fusing device; numeral 32 is the thermistor serving as the thermal detecting member; numeral 52 is a fusing roller rotatably arranged;

numeral 53 is a heating roller serving as a heating member rotatably arranged with a predetermined distance to the fusing roller 52; and numeral 54 is a fusing belt serving as a belt member as well as an endless fusing member, arranged as tensioned in a manner that the fusing belt can move and drive freely, between the fusing roller 52 and the heating roller 53. The pressure roller 33 serving as a pressure member is rotatably arranged as faced with the fusing roller 52 through the fusing belt 54. The halogen lamps respectively serving as the first, second, and third heating elements are respectively arranged inside the fusing roller 52, the heating roller 53, and the pressure roller 33, so heating from the halogen lamps heats the fusing belt 54 through the fusing roller 52, the heating roller 53, and the pressure roller 33.

The toner image in each color on a paper, furthermore, is fused to form the color image while the paper as the recording medium passes between the fusing belt 54 and the thermistor 32.

In this situation, regarding the fusing belt 54, a polyfluoroalkoxy resin serving as a releasing material as well as a fluoric resin is covered by coating on a film as a base material composed of prescribed materials to form a surface, and the film member 58 serving as the original fusing member thus formed is thereafter dried and annealed, and subsequently, the mat process is made thereto.

To achieve the above, the power supply 36 supplies the electric power to the induction heating device arranged inside the jacket roll 35 serving as the member for the mat process, and the induction heating device heats the jacket roll 35 by the induction heating so the surface temperature thereof becomes 200 to 350 degrees Celsius. The surface roughness of the jacket roll 35 is transferred to the surface of the film member 58 when the film member 58, as shown in FIG. 12, is pressed with pressing force of 1 to 10 [kg] onto the jacket roll 35, and in that state, the jacket roll 35 is rotated in a direction of arrow A for 5 to 30 seconds while the film member 58 is driven to be rotated in a direction of arrow D. As the result, the surface of the film member 58 is made mat to be set to an arbitrary surface roughness Rz. The fusing belt 54 can be thus manufactured.

In that case also, it is turned out that where the surface roughness Rz of the fusing belt 54 is set to 1.0 to 4.0 [μm] with respect to the average roughness, the image quality does not deteriorate since the surface of the fusing belt 54 is roughed. Preferably, where the surface roughness Rz is set to 1.5 to 3.5 [μm] with respect to the average roughness, the image quality does not deteriorate at all, thereby being able to be settled.

In this embodiment, the halogen lamp is arranged inside the fusing roller 52, the heating roller 53, and the pressure roller 33, but can be arranged inside the heating roller 53 only, or inside the fusing roller 52 and the heating roller 53.

It is to be noted that this invention is not limited to these above described embodiments but can be variously modified based on the purpose of this invention, and these modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fusing device comprising:

a pressure member;

a fusing member movably arranged facing said pressure member and heated with heat generated by a heating element; and a contact element arranged in contact with a medium transmission area on an outer circumferential surface of said fusing member, wherein said fusing member has a surface roughness set to 1.0 to 4.0 μm, wherein said contact element produces a surface roughness of 1.0 to 4.0 μm when rubbed in contact with the fusing member, whereby gloss unevenness caused by a trace of the contact element is reduced in the printed results.

2. The fusing device according to claim 1, wherein said fusing member is a fusing roller or a fusing belt.

3. The fusing device according to claim 1, wherein said contact element is a thermal detecting member for detecting the surface temperature of the fusing member.

4. The fusing device according to claim 1, wherein the surface roughness of said fusing member is preferably set to 1.5 to 3.5 μm.

5. The fusing device according to claim 1, wherein said fusing member is formed upon applying a resin onto a surface thereof.

6. The fusing device according to claim 1, wherein said fusing member is covered with a resin made tube.

7. The fusing device according to claim 1, and further comprising a heating element for heating said pressure member.

* * * * *